United States Patent [19]

Magadini

[11] 3,930,431

[45] Jan. 6, 1976

[54] MECHANISM FOR OPERATING A BASS DRUM

[76] Inventor: Peter C. Magadini, 3611 E. Pierson St., Phoenix, Ariz. 85018

[22] Filed: Nov. 5, 1974

[21] Appl. No.: 520,971

[52] U.S. Cl. ..... 84/422

[51] Int. Cl.[2] ..... G10D 13/00

[58] Field of Search ..... 84/422

[56] References Cited

UNITED STATES PATENTS

| | | | |
|---|---|---|---|
| 1,042,919 | 10/1912 | Hughes | 84/422 |
| 3,030,847 | 4/1962 | Thompson | 84/422 |
| 3,426,640 | 2/1969 | Slingerland | 84/422 |
| 3,797,356 | 3/1974 | Duffy et al. | 84/422 |

*Primary Examiner*—Lawrence R. Franklin
*Attorney, Agent, or Firm*—George H. Riches

[57] ABSTRACT

This invention discloses a novel and improved mechanism for operating a bass drum which is totally adjustable. A telescoping rod and tube assembly is provided whereby the position and the height of the foot pedal may be adjusted to suit the operator's individual needs. The position of the mechanism may be arcuately adjusted about the drum head as well as the distance through which the beater ball moves to strike the drum head and the force required to be exerted on the depressible foot pedal to cause the beater ball to move. These various adjustments may be made singly or in concert.

7 Claims, 5 Drawing Figures

A
A

MECHANISM FOR OPERATING A BASS DRUM

BACKGROUND OF THE INVENTION

This invention relates generally to a mechanism for operating a bass drum and more particularly, to an adjustable bass drum pedal and beater mechanism therefor.

BRIEF DESCRIPTION OF THE PRIOR ART

Mechanisms for operating a bass drum have included a depressible foot pedal, which when depressed, activates a means which causes a beater ball to move through an arc and strike a bass drum. When the pedal is released, the beater ball will return to a resting position ready to move forward to strike the drum when activated again.

However, in the conventional bass drum pedal, no mechanism has been provided to allow the operator to adjust the position of the foot pedal in all directions in a quick and efficient manner as well as to adjust the direction of the beater ball and the distance it must travel to strike the bass drum. The lack of adjustability with the mechanisms of the prior art has been a problem, particularly with equipment used for instructional purposes. It is a well known fact that the feet of different people are different in both shape and size. It is therefore a distinct advantage to provide a mechanism which would allow the operator thereof to adjust the position, the height and angle of the foot pedal, the distance the beater ball must travel to the bass drum, the angle between the beater ball and the drum, and the pressure required to be applied to the foot pedal to cause the beater ball to strike the drum in a quick and efficient manner.

The adjustability of the aforementioned constants is particularly important if the operator has an irregularly shaped or diseased foot or muscle controlling movement of the foot.

The adjustability of the pressure required to activate the means to cause the beater ball to strike the bass drum provides a further advantage over the prior art. Different types of music will require different rhythms and beats to be played by the musicians and, in particular, will require different bass drum beats. With a totally adjustable mechanism, the operator will be able to adjust the travel of his foot so that he will be able to play a much faster or slower beat or a louder or softer beat on the bass drum with a minimum of effort.

It is also a fact that certain persons have difficulty in depressing the foot pedal of the conventional apparatus due to the strength required. The present invention alleviates such a problem in that the amount of pressure necessary to depress the foot pedal may be reduced.

SUMMARY OF THE INVENTION

Accordingly, it is an object of the present invention to provide a fully adjustable mechanism for playing a bass drum wherein the position of the foot pedal may be adjusted in all directions.

It is another object of the invention to provide a mechanism for operating a bass drum wherein both the distance between the foot pedal and the bass drum and the height of the foot pedal may be varied in a quick, easy and efficient manner.

Still a further object of the present invention is to provide a means for adjusting the distance the beater ball must move to strike the bass drum.

A still further object of the present invention is to provide a means to adjust the pressure necessary to be applied to the foot pedal to cause the beater ball to move from a resting position to strike the bass drum.

Yet a still further object of the present invention is to provide means to control the travel required by the foot pedal to cause the beater ball to move from a resting position to strike the bass drum.

BRIEF DESCRIPTION OF THE DRAWINGS

In the drawings, to which reference will now be made in this application, similar reference characters have been employed to designate corresponding parts throughout the several drawings.

DESCRIPTION OF THE PREFERRED EMBODIMENTS

Figure 1:
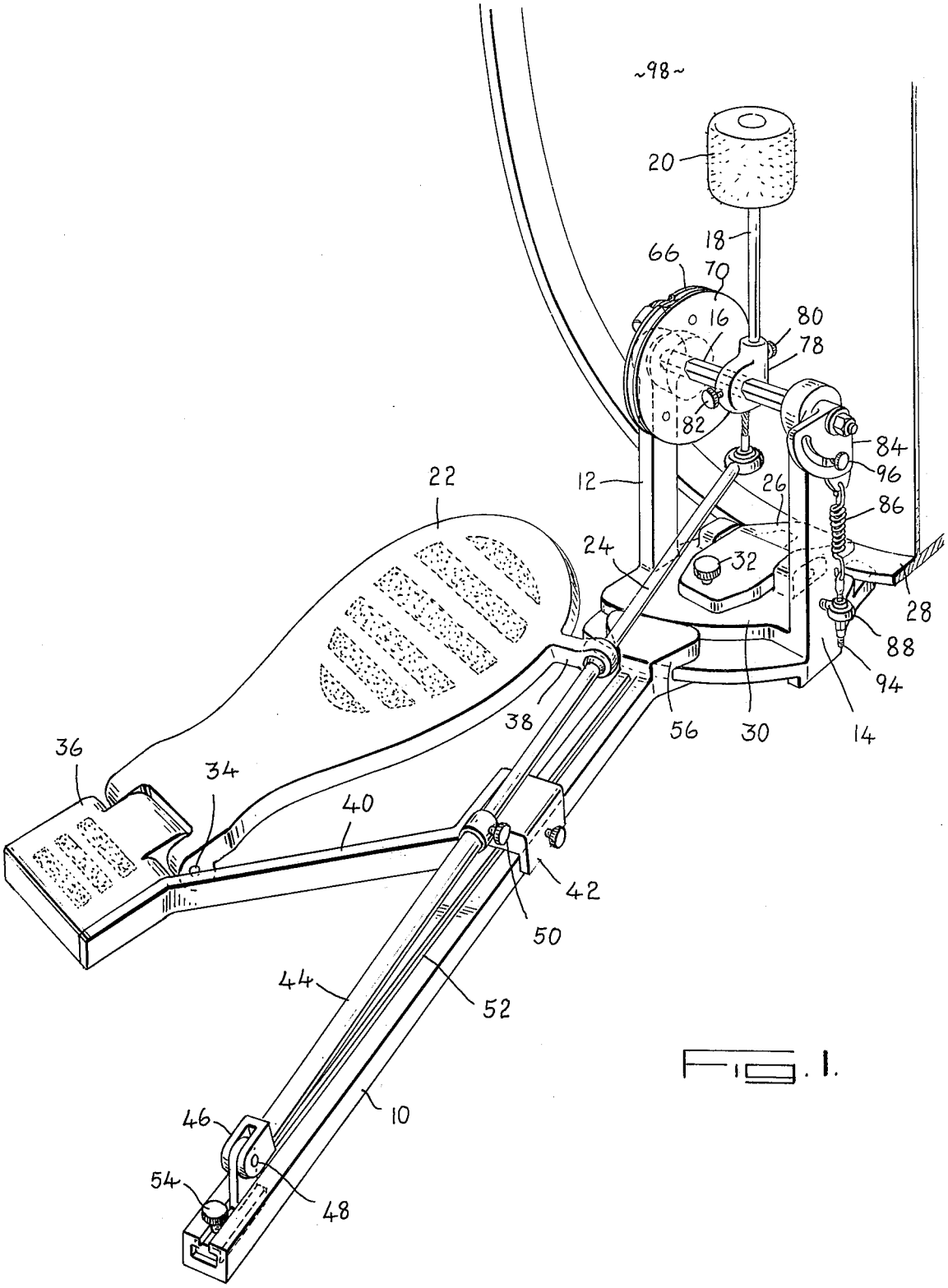
FIG. 1 is a perspective view of a mechanism for operating a bass drum embodying the present invention and affixed to a bass drum.
Figures 2, 3, 4:
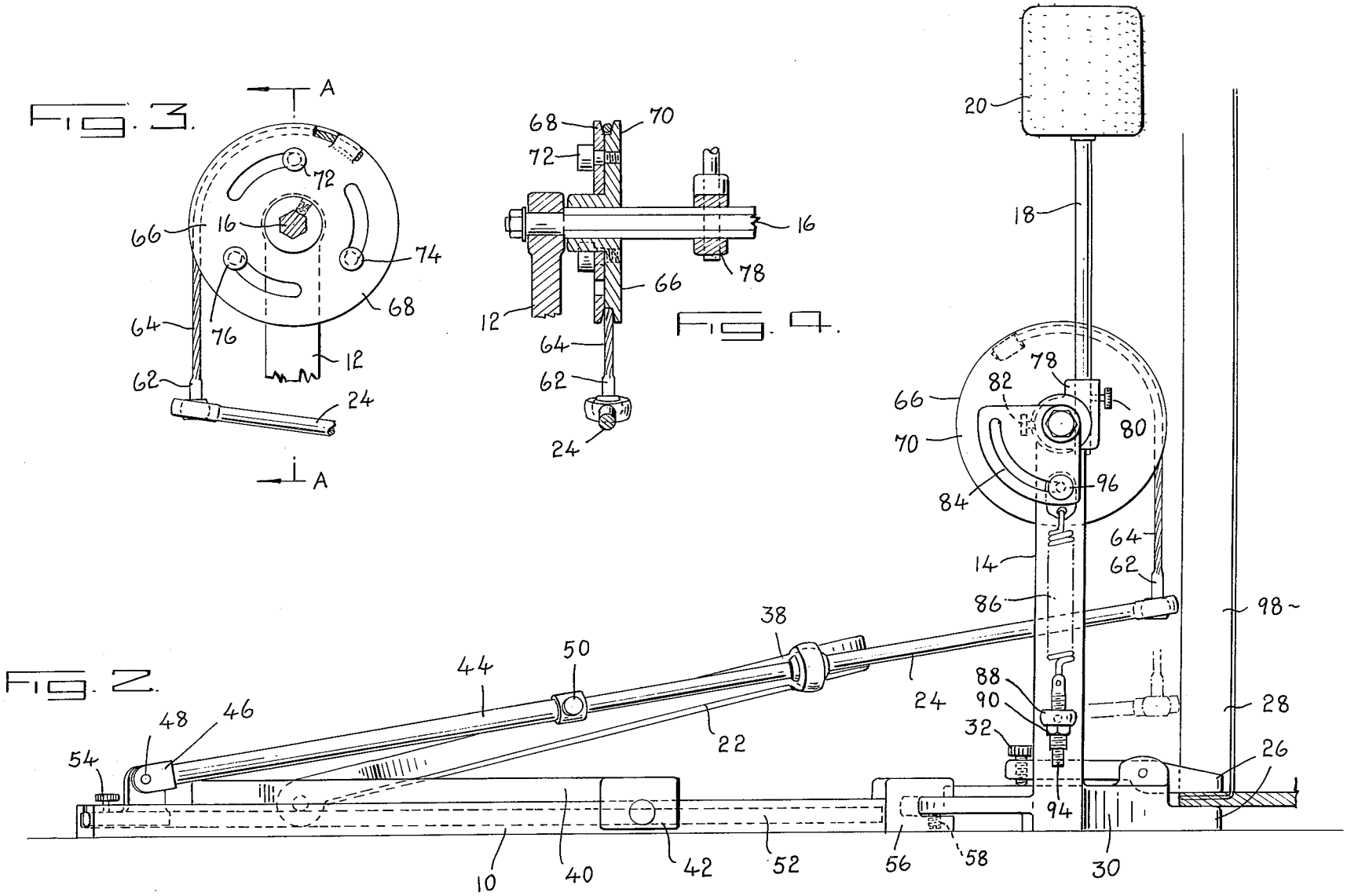
FIG. 2 is a side elevational view of an embodiment of the present invention.
FIG. 3 is a fragmentary sectional view showing means for transmission of the pedal motion to the beater rod.
FIG. 4 is a cross-sectional view taken along the line A—A of FIG. 3.
Figure 5:
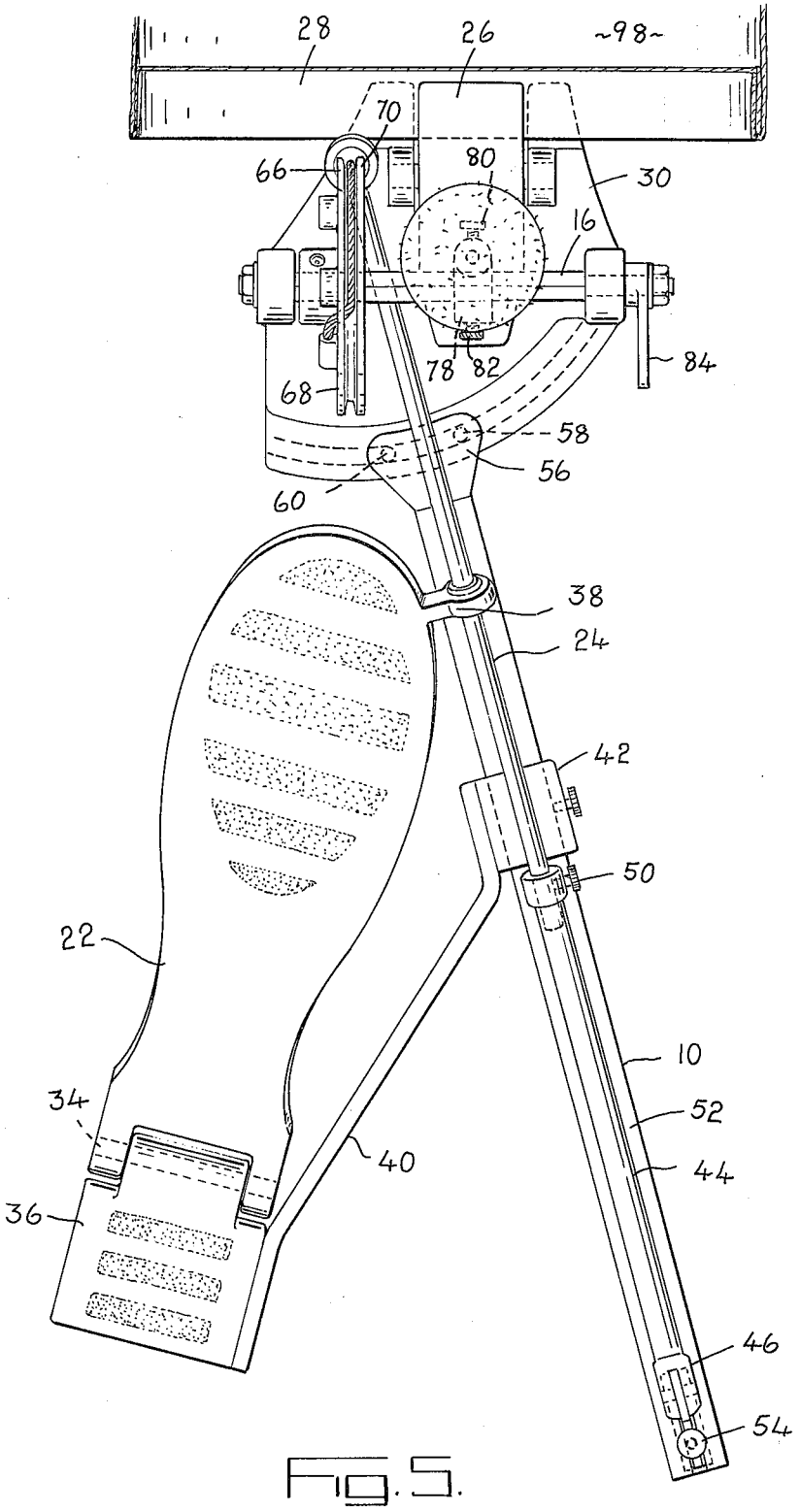
FIG. 5 is a top plan view of an embodiment of the present invention.

The mechanism for operating a bass drum of the present invention consists generally of a base 10, a support comprising vertical side posts 12 and 14 and shaft 16, beater rod 18, beater ball 20, foot pedal 22 and a rod 24 connecting the foot pedal 22 and the shaft 16. A drum clamp 26 affixes to the rim 28 of a bass drum 98 and is affixed to a base plate 30 of the support and is held by a screw 32.

The foot pedal 22 is pivotally mounted by a pin 34 onto a heel plate 36 and pivots in a vertical direction. The forward portion of the foot pedal 22 is slidably mounted by a first bracket 38 onto the rod 24 and the heel plate 36 is slidably mounted to the base 10 by a second bracket 40 and fastened by fastener 42.

Rod 24 is telescopic into tube 44 which is pivotally mounted through pin 48 on base 10 by clamp 46 and its position is held by screw clamp 50. The rearward end of tube 44 is also slidably mounted in track 52 in the base 10 and held in position by thumb screw 54.

The base 10 is adjustably clamped onto the leading edge of the base plate 30 by a track clamp 56 and is held by first and second track clamp screws 58 and 60.

The forward end of the rod 24 is affixed to a swivel connector 62 which is held by a cable 64 which is wound around a portion of a wheel 66 comprising a first half-wheel 68 and a complimentary second half wheel 70. The first half-wheel 68 is fastened to the second half-wheel by first wheel screw 72, second wheel screw 74 and third wheel screw 76.

The beater ball 20 is affixed to a beater rod 18 leading to a horizontal shaft 16 and adjustably held on the shaft by a rod bracket 78. A first bracket screw 80 holds the beater rod 18 in position by contact pressure. Rod bracket 78 is also affixed to shaft 16 and is held in place by a second bracket screw 82 by contact pressure.

The end of the shaft 16 opposite to the wheel 66 contains an adjustable bracket 84, held by a beater angle adjuster screw 96 to which a spring 86 is affixed. The lower end of the spring is connected to a swivel bearing 88, a tension nut 90, and to a connector 94 affixed to the post 14 by a stud.

The present invention provides many novel adjustable features. The position of the foot pedal 22 may be adjusted independently of the position of the base plate 30 or the base 10. The fastener 42 is loosened and second bracket 40 is moved either forward or rearward sliding on base 10. First bracket 38 slides on rod 24 from screw clamp 50 to the foremost end of the rod. Then the position of the foot pedal 22 may be varied and it brought closer to the drum or further away as determined by the operator thereof.

A second adjustable feature of the present invention is the adjustability of the total length of the rod 24 and the tube 44. As stated hereinbefore, rod 24 is telescopically adjustable into tube 44. Thus, if screw clamp 50 and thumb screw 54 are loosened, clamp 46 may be adjusted along track 52 thereby reducing the length of rod 52 and thereby reducing the combined length of rod 24 and tube 44. This will cause the position of foot pedal 22 to be varied according to the operator's preference. This adjustment produces a different effect than the first noted adjustment and the effects will be described hereinafter.

A third adjustable feature of the present invention is the angle at which the foot pedal is viz-a-viz the bass drum 98. Track clamp 56 may be adjusted by loosening first track clamp screw 58 and second track clamp screw 60 and travelled in an arc along the front lip of the base plate 30. Once a position comfortable to the operator is found, the first track clamp screw 58 and second track clamp screw 60 are tightened to a secure position and thus, the angle at which the operator's foot is positioned to use this pedal may be adjusted to each player's needs.

A fourth adjustable feature of this invention is well known in the prior art and resides in the drum clamp 26. The position of the drum clamp 26 on the rim 28 is adjusted by loosening screw 32 and adjusting the drum clamp 26 to the desired position.

A fifth adjustable feature of the present invention is the ability to vary the length of the cable 64 and therefore the height of the resting position of the foot pedal 22. If the length of the cable is decreased, the height of the foot pedal 22 above the base 10 in a resting position would be increased. Therefore, the operator could adjust the height of the foot pedal 22 to his particular needs.

In order to adjust the length of the cable 64, the first wheel screw 72, the second wheel screw 74 and the third wheel screw 76 are loosened. Wheel 66 consists of first half wheel 68 and second half wheel 70. The cable 64 is affixed to one of said half wheels which is rotatable about the shaft 16. The other of said half wheels is permanently fixed to the shaft 16. Thus, when the half wheel affixed to the cable 64 is rotated about the shaft 16 and then tightened to the fixed half wheel portion, the length of the cable 64 may be effectively increased or decreased. This raises or lowers the height of the rod 24 above the base 10 and adjusts the position of the foot pedal 22.

A sixth adjustable feature of the present invention is that the angle between the base of the beater rod 18 and the bass drum 98 may be adjusted thereby adjusting the distance between the beater ball 20 and the bass drum 98.

The beater angle adjuster screw 96 is loosened and the adjustable bracket is arcuately adjusted. This bracket is affixed to the shaft 16 and therefore, when rotated, will in turn rotate the shaft 16. Since the beater rod 18 is affixed to the shaft 16, when the adjustable bracket is rotated, the angle between the beater rod 18 and the drum 98 will change and therefore, the distance between the beater ball 20 and the drum 98 will also change. Once the desired position is located, then the beater adjuster screw 96 is tightened.

A seventh adjustable feature of the present invention is well known in the art and comprises the increase or decrease in the tension of the spring 86 by rotating tension nut 90 in one direction or in the other. The tension in the spring controls the return of the beater ball 20 to the resting position and contributes to the control of the amount of pressure necessary to be applied to the foot pedal 22 to move the beater rod 18 from the resting position to the drum 98.

The operator of the present invention is able to vary the position of the foot pedal, the pressure necessary to be applied to depress the foot pedal, the distance through which the foot pedal must travel in order to cause the beater ball to strike the drum, the angle of the foot pedal to the drum and the distance the beater ball must travel from a resting position to strike the bass drum. These adjustments may be made singly or in concert according to his or her individual needs and preferences.

A brief explanation of the effect of the adjustments will now be outlined. A normal position shall be assumed when the clamp 46 at the end of the tube 44 is attached to the rearwardmost position of track 52 and when fastener 42 is also as far to the rear on the base 10 as possible. As the fastener 42 is moved forward along base 10 with tube 44 remaining stationary, the amount of force necessary to depress the pedal 22 to produce the same movement of the beater ball 20 is decreased but the distance through which the pedal 22 must move is increased. Therefore, less effort is required to produce the same beat but the pressure must be maintained for a longer period of time.

If the clamp 42 is moved to its forward position and the clamp 46 is also moved to the forward position thus telescoping the rod 24 into the tube 44, the amount of force necessary to depress the pedal 22 is more than in the first situation but the distance through which the pedal 22 must move is the same.

It has been found that the distance through which the pedal 22 must be depressed does not change substantially as clamp 46 is adjusted to various positions along the track 52. It appears that the pressure through which the foot pedal must move to the beater ball 20 is a function of the position of the clamp 46 in the track 52.

The adjustability of the position of the foot pedal 22 through track clamp 56 is particularly important for people with diseased or malformed feet and also is important for people with "normal feet" because the size, shape and position of the feet of all people may vary. Therefore, the adjustable foot pedal of the present invention would be welcomed by both people with normal and abnormal" feet. The conventional apparatus provides only one position of the foot pedal for the operator. However, with the apparatus of the present invention, the position of the foot pedal 22 is fully adjustable to suit each individual's needs.

Varying the length of cable 64 will vary the height of the foot pedal by raising or lowering the rod 24. This allows the individual to adjust the height of the pedal to the most comfortable position for his foot.

Adjusting the angle between the beater rod 18 and the bass drum 98 will vary the distance required for the beater ball 20 to travel from the resting position to strike the drum 98.

The adjustability of this distance is particularly important when different types and styles of bass drum beats are required by the distinct and varied types of music played today. If the distance between the beater ball 20 (in a resting position) and the bass drum is shortened, it has been found that the operator can sustain a much quicker beat with less effort since the beater ball 20 does not have to travel a great distance to strike the drum 98. If the distance were lengthened, it has been found that the strength of the beat may be increased because more power may be exerted through the increased distance.

Adjusting the tension nut 90 will also effect the pressure required to be exerted on the foot pedal to produce the required beat. The length of the beater rod 18 is adjustable by first bracket screw 80 and this will affect at what spot on the drum head that the beater ball 20 will strike.

This invention discloses many different adjustable features which may be found in concert or alone and still fall within the scope of the present invention. It is possible to manufacture an adjustable bass drum pedal with a one-piece rod rather than the rod and tube as described in the preferred embodiment and retain one or more of the remaining adjustable features. Similarly, other combinations of adjustable features may be incorporated into a bass drum mechanism along with the non-adjustable features of the prior art.

Although the disclosure describes and illustrates a preferred embodiment of the invention, it is to be understood the invention is not restricted to this particular embodiment.

What is claimed is:

1. In a mechanism for operating a bass drum comprising a base, a vertical support affixed to the forward edge of the base, said vertical support comprising a flat plate, two vertical posts at opposite ends of said plate and a shaft connecting said posts at their upper ends, said flat plate adapted to be clamped to a rim of a bass drum; a beater ball affixed to the upper end of a beater rod, said beater rod affixed to said shaft, a foot pedal, a connector means connecting said foot pedal to said support and adjustably connecting said foot pedal to said base, the improvement comprising said vertical support containing a flat plate having a convex-shaped outer rim to which the leading edge of said base is adjustably affixed so that the position of the base and therefore said foot pedal with respect to said bass drum may be arcuately adjusted by adjusting the point of affixation of said base on said rim of said plate.

2. A mechanism for operating a bass drum comprising:

a base with a track therein;

a vertical support arcuately and adjustably affixed to the forward edge of the base, said support comprising a flat plate having a rounded outer edge, two vertical posts at opposite ends of said plate and a shaft journaled in said posts at their upper ends, said flat plate adapted to be clamped to a rim of a bass drum, said base adapted to be arcuately and adjustably affixed to said rounded outer edge of said flat plate;

a beater ball affixed to the upper end of a beater rod, said beater rod adjustably secured to said shaft;

a foot pedal comprising a heel plate and a depressible foot portion;

first connector means adjustably connecting said foot pedal to said support and adjustably connecting said foot pedal to said base;

whereby the position, height and angle of the depressible foot portion of said foot pedal with respect to said bass drum may be adjusted by adjusting said connector means and the position of said foot portion may be laterally adjusted by adjusting the point of affixation of said base to said support.

3. A mechanism for operating a bass drum as claimed in claim 2 wherein said first connector means comprises:

a rod telescopically mounted in a tube and the rearward end of said tube is slidably seated in said track;

a cable affixed to the forward end of said rod;

a wheel rotatably affixed to said shaft, said cable being wound around said wheel and affixed to said wheel;

first attachment means slidably attaching said foot pedal to said rod;

second attachment means adjustably attaching said heel plate to said base;

wherein said rod telescopes into said tube as the point of seating of the tube is advanced in said track towards the support whereby the position of the foot pedal may be adjusted by adjusting the point of seating of said tube in said track alone or in concert with adjusting the position of the point of attachment of the second attachment means and said base.

4. A mechanism for operating a bass drum as claimed in claim 3 wherein said wheel comprises:

first half wheel and second half wheel, said first half wheel being permanently affixed to said shaft, said cable being affixed to said second half wheel, said second half wheel being rotatable about said shaft and adjustably affixed to said first half wheel, whereby the length of the cable may be increased or decreased by rotating said second half wheel while said first half wheel is stationary thereby raising or lowering the height of the foot portion of said foot pedal above the ground.

5. A mechanism for operating a bass drum as claimed in claim 2 wherein said vertical support includes:

returning means affixed to one of said supporting posts to effect a return movement of said shaft to a resting position after said foot pedal has been depressed and released.

6. A mechanism for operating a bass drum comprising a base having a track therein, a vertical support adjustably affixed to the leading edge of said base, said support comprising:

a flat plate adapted to be clamped to a rim on a bass drum and adjustably affixed to the leading edge of said base;

two horizontally aligned vertical support posts at opposite ends of said plate;

a shaft journaled in said posts at the uppermost inner surfaces;

returning means affixed to one of said support posts adapted to effect a return movement of said shaft to a resting position;

a beater ball affixed to the upper end of a beater rod, said beater rod being adjustable secured to said shaft, a foot pedal comprising:

a heel plate;

a depressible foot portion; first connector means adjustably affixed to said foot pedal and adjustably affixed to said support comprising:

a rod telescopically mounted in a tube and said tube being slidably seated in said track;

a cable pivotally affixed to the tip of said rod;

a wheel rotatably affixed to said shaft comprising:

first half wheel;

second half wheel, said first half wheel being permanently affixed to said shaft, said cable being affixed to said second half wheel, said second half wheel being rotatable about said shaft and adjustably affixed to said first half wheel;

first attachment means slidably attaching said foot pedal to said rod;

second attachment means adjustably attaching said heel plate to said base; whereby the position of the depressible foot pedal may be adjusted independently of adjusting the position of the whole mechanism.

7. A mechanism for operating a bass drum as claimed in claim 2 wherein said first connector means comprises:

a rod whose rearward end is seated in said track;

a cable affixed to the forward end of said rod;

a wheel rotatably affixed to said shaft, said cable being wound around said wheel and affixed to said wheel;

first attachment means slidably attaching said foot pedal to said rod;

second attachment means adjustably attaching said heel plate to said base;

wherein the position of the foot pedal may be adjusted by adjusting the position of the point of attachment of the second attachment means and said base thereby adjusting the point of attachment of said first attachment means on said rod.

* * * * *